United States Patent [19]

Wierenga

[11] 4,268,038

[45] May 19, 1981

[54] ACCESSORY FOR AN ARROW

[75] Inventor: Allen J. Wierenga, Hopkins, Mich.

[73] Assignee: Philip A.D. Machine, Inc., Wayland, Mich.

[21] Appl. No.: 93,632

[22] Filed: Nov. 13, 1979

[51] Int. Cl.[3] ..... F41B 5/02

[52] U.S. Cl. ..... 273/416; 273/421; 30/352

[58] Field of Search ..... 273/416, 419–422; 30/346, 352, 355, 356

[56] References Cited

U.S. PATENT DOCUMENTS

| | | | |
|---|---|---|---|
| 2,888,264 | 5/1959 | Sharrar et al. | 273/421 X |
| 3,398,960 | 8/1968 | Carroll, Jr. | 273/422 |
| 3,565,435 | 2/1971 | Bear | 273/421 |
| 3,604,708 | 9/1971 | Brozina | 273/422 |
| 3,897,062 | 7/1975 | Christensen | 273/421 |
| 4,166,619 | 9/1979 | Bergmann et al. | 273/421 |

*Primary Examiner*—Paul E. Shapiro

*Attorney, Agent, or Firm*—Price, Heneveld, Huizenga & Cooper

[57] ABSTRACT

An accessory for a hunting arrow is disclosed designed to be mounted around the shaft of the arrow at the base of the arrow head. The accessory consists of a coil of ribbon-like resilient material which is tightly wound and held in coiled position by a latch. The latch releases the coil as the result of a finger on the latch catching on the target as the arrow penetrates.

12 Claims, 5 Drawing Figures

ACCESSORY FOR AN ARROW

BACKGROUND OF THE INVENTION

While the bow and arrow is one of the oldest of man's hunting tools and has been improved to the point where it presently is a weapon of vastly increased lethal characteristics than it was a mere 100 years ago, it is still far from ideal as a weapon for hunting larger animals. It has long been recognized that while bow and arrow hunting requires substantially greater skills than the use of fire arms, it has the undesirable characteristic of wounding many animals which are still capable of escaping from the hunter only to die later as a delayed reaction of the arrow. This is undesirable for many reasons. Among the fundamental reasons why an arrow is less effective than a fire arm as a lethal weapon is the fact that in many cases it does not create sufficient physical damage to produce an immediate or substantially immediate lethal effect.

BRIEF DESCRIPTION OF THE INVENTION

The objective of the invention is to substantially increase the immediate lethal effect of an arrow. To this end the invention provides an accessory to be mounted on the conventional arrow which will greatly increase the physical damage caused by the arrow and will assure a rapid and quick bleeding of the animal struck with the arrow to assure a swift and certain lethal effect such that death comes quickly before the animal has an opportunity to escape from the immediate area of the hunter. The invention is designed to be sufficiently light and compact that it does not materially affect the trajectory of the arrow and does not adversely affect the directional accuracy of the arrow. To this end, it does not, to any significant degree, interfere with the balance initially built in to the arrow.

DESCRIPTION OF THE PREFERRED EMBODIMENT

Figure 1:
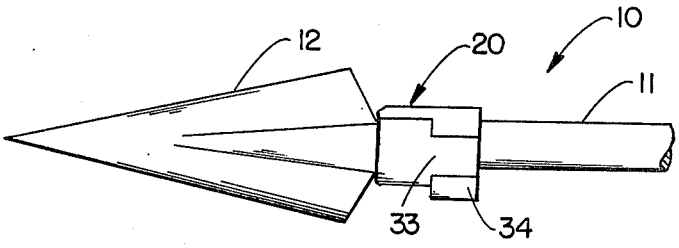
FIG. 1 is a fragmentary view of the head end of an arrow equipped with this invention.
Figure 2:
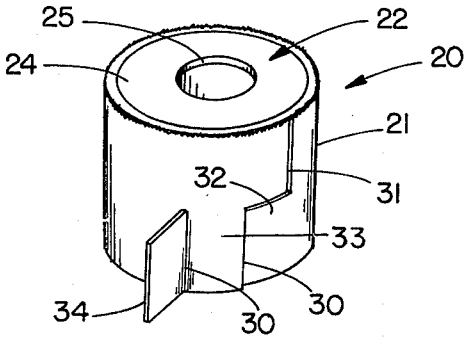
FIG. 2 is an enlarged, oblique view of the invention before attachment to the arrow.
Figure 4:
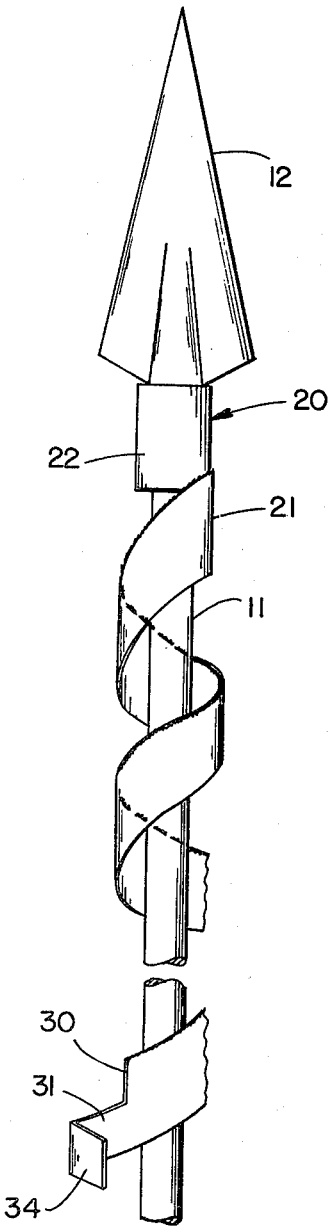
FIG. 4 is a view of an arrow showing the position assumed by the invention after it has been released upon impact with target.
Figure 3:
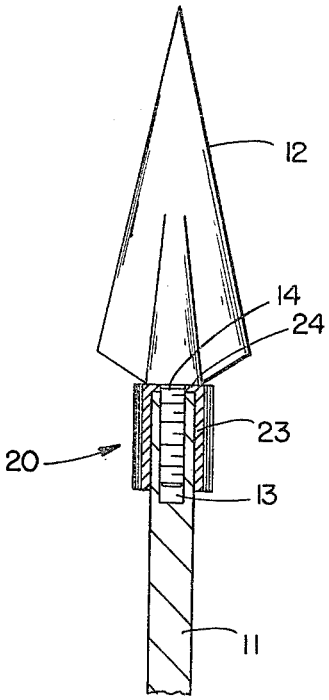
FIG. 3 is a central section of an arrow head showing the invention mounted ready for use.
Figure 5:
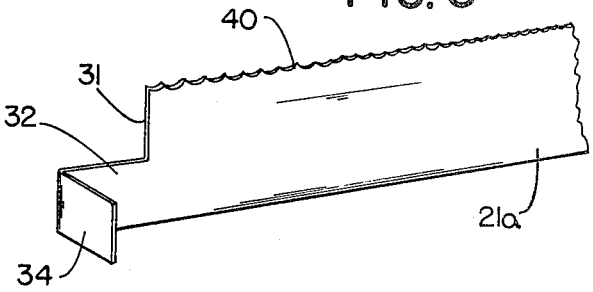
FIG. 5 is a fragmentary, enlarged view of a modified form of the invention.

The numeral 10 indicates an arrow having a shaft 11 and a head 12. Both the shaft and the head are conventional and, as illustrated in FIG. 3, the front end of the shaft has an internally threaded opening 13 to receive the threaded shank 14 of the arrow head. In general the various arrow heads and shafts are interchangeable, permitting any number of arrow heads of various designs, sizes and shapes to be mounted on any one of a number of different shafts. So far as this invention is concerned, it is possible to reverse the threaded opening and shank in such a way that the female threaded opening is in the arrow head and the male portion of the attachment is part of the shaft.

The invention is an attachment 20 designed to be mounted on the arrow between the head 12 and the shaft 11. The attachment includes an elongated, narrow ribbon 21 of a resilient material, preferably a stainless, spring steel. In a preferred embodiment, it has a width of ½ inch and a length of approximately 10 inches. This ribbon 21 is tightly coiled about a shell 22 which has an inner opening of a size to slidably but closely fit about the arrow shaft 11. Thus, it forms the sleeve 23 which seats about the shaft and holds the attachment against any wobble or vibration with respect to the shaft. This is important to eliminate any adverse affect upon the arrow's accuracy.

At the forward end of the sleeve, the attachment has an inwardly extending flange 24 which seats over the end of the shaft and has a central opening 25 of a size to just closely fit around the threaded stem or extension 14 of the arrow. By this arrangement the invention can be mounted on an arrow simply by sliding it over the end of the shaft and then mounting the arrow with the rear end of the arrow tightly clamping the flange 24 between it and the front end of the shaft.

Adjacent its outer end, the ribbon 21 is provided with a pair of spaced slits 30 extending from the rear edge of the next to the outermost coil to a position approximately half way across the width of the ribbon. Also, the outer end of the ribbon is notched at 31 so that it has an extending tail 32 of a length and size to be received through the slits 30 and behind the finger 33 created between the slits. The end of the tail 32 is bent outwardly to form a radially extending catch 34.

The inner end of the ribbon 21 is secured to the shell 22 by any suitable means such as spot welding. The ribbon is then tightly wound around the shell and is releasably locked in the wound position by placing the end tail 32 beneath the finger 33 with the catch 34 holding the ribbon against withdrawal from behind the finger 33.

Because it is important that the entire attachment be as light and as compact as possible, all parts of it are designed to be thin. For example, the flange 24 can be of 0.015 to 0.020 while the walls of the shell can be 0.015 stainless steel. A preferable material for the ribbon is 0.005 stainless spring steel. In a preferred construction the catch 34 extends approximately a ¼ inch outwardly from the surface of the coil 21.

When an arrow equipped with this invention strikes a target, as the arrow head initially penetrates the target, the catch 34 engages the target and pulls the end of the ribbon 21 free of the finger 33, this permits the tightly wound spring coil to release. As the arrow continues to penetrate the target, the uncoiling of the ribbon multiplies the amount of physical damage done to the target. Furthermore, since the catch remains basically at the exterior of the target, the ribbon extends as a coil in as far as the head of the arrow penetrates. This assures a large and open wound which will result in positive and rapid bleeding and thus greatly increases the chances that the wound will be not only lethal but quickly lethal rather than requiring a period of slow bleeding and infection to cause death. Thus, it not only greatly increases the chance that the hunter will recover his quarry but it also materially reduces the possibility of the animal suffering a lingering and painful death.

To further increase the effectiveness of the invention, the forward edge of the ribbon 21*a* may be scalloped at 40 to provide a large number of small, sharp forwardly extending teeth to further increase the power of the invention to produce immediate or substantially immediate death to the hunter's quarry.

Having described my invention and the manner of its use, it will be recognized that various modifications of the invention can be made. Such of these modifications as do not depart from the principle of the invention are to be considered as included in the hereinafter appended claims unless these claims by their language expressly state otherwise.

The embodiments of the invention in which an exclusive property or privilege is claimed are defined as follows:

1. An attachment for a hunting arrow, said arrow having a head and a shaft, said attachment comprising a coiled ribbon-like strip of resilient material surrounding said shaft adjacent said head; releasable means holding said strip in said coiled condition; a releasable catch projecting outwardly from said coil for engaging the target as the head of the arrow penetrates the target for releasing said strip and freeing it to uncoil.

2. An attachment for a hunting arrow as described in claim 1 wherein said resilient material is stainless, spring steel.

3. An attachment for a hunting arrow as described in claim 2 wherein one end of said strip is anchored to said shaft and the releasable means is at the other end; said other end being of reduced width for a portion of the circumference of said coil; a pair of spaced slots in said strip forming a tab therebetween, said tab being aligned circumferentially with said portion of reduced width and receiving said portion therebehind to form said releasable holding means.

4. An attachment for a hunting arrow as described in claim 3 wherein said release catch is the end of said portion bent to extend radially outwardly.

5. An attachment for a hunting arrow as described in claim 1 wherein a shell is provided, said coil being wrapped around said shell, said shell on one end having a radially inwardly extending flange; said flange being seated between said head and said shaft.

6. An attachment for a hunting arrow as described in claim 5 wherein one end of said strip is anchored to said shell and the releasable means is at the other end; said other end being of reduced width for a portion of the circumference of said coil; a pair of spaced slots in said strip forming a tab therebetween extending axially rearwardly, said tab being aligned circumferentially with said portion of reduced width and receiving said portion therebehind to form said releasable holding means.

7. An attachment for a hunting arrow as described in claim 1 or 2 wherein the forwardly facing edge of said strip is serrated.

8. An attachment for a hunting arrow, a shell having an internal opening of a size to seat over an arrow shaft; a tightly wound coil of ribbon-like resilient material surrounding said shaft adjacent said head; releasable means holding said material in said coiled condition; a releasable catch projecting outwardly from said coil for engaging a target as the arrow makes its initial penetration for releasing the strip and freeing it to uncoil.

9. An attachment for a hunting arrow as described in claim 8 wherein said arrow has a head and means are provided for securing said coil to said arrow at the base of the head.

10. An attachment for a hunting arrow as described in claim 9 wherein said means is a shell having an inwardly extending flange adapted to seat between the base of the arrow head and the forward end of the arrow shaft.

11. In combination an arrow having a head and shaft threadedly joined thereto at the base of the head, the threaded joint between said head and shaft forming a shoulder at the forward end of the shaft; a shell having an internal opening of a size to receive and seat closely about said shaft; said shell having a radially inwardly extending flange at its forward end seated on said shoulder and clamped between said shoulder and the base of said head; a coil of ribbon-like resilient material tightly wound about said shell and having one end secured thereto; releasable means holding said material in said coiled condition; a releasable catch projecting outwardly from said coil for engaging a target as the arrow enters for releasing the strip and freeing it to uncoil.

12. The combination recited in claim 11 wherein said material is stainless spring steel and the forward edge thereof is serrated.

* * * * *

UNITED STATES PATENT AND TRADEMARK OFFICE

CERTIFICATE OF CORRECTION

PATENT NO. : 4,268,038

DATED : May 19, 1981

INVENTOR(S) : Allen J. Wierenga

It is certified that error appears in the above—identified patent and that said Letters Patent is hereby corrected as shown below:

Assignee:

"Philip A.D. Machine, Inc." should be --Philp A.D. Machine, Inc.--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*